US006619512B1

(12) United States Patent
Sayers et al.

(10) Patent No.: US 6,619,512 B1
(45) Date of Patent: Sep. 16, 2003

(54) LOCK-OUT MECHANISM FOR DISPENSER

(75) Inventors: Richard C. Sayers, Akron, OH (US); Robert H. Yeager, Twinsburg, OH (US); Nick E. Ciavarella, Seven Hills, OH (US)

(73) Assignee: Joseph S. Kanfer, Richfield, OH (US)

( * ) Notice: Subject to any disclaimer, the term of this patent is extended or adjusted under 35 U.S.C. 154(b) by 0 days.

(21) Appl. No.: 10/195,681

(22) Filed: Jul. 16, 2002

(51) Int. Cl.[7] ..... B65D 37/00
(52) U.S. Cl. ..... 222/207; 222/181.3; 222/325
(58) Field of Search ..... 222/325, 207, 222/214, 215, 181.1, 181.2, 181.3

(56) References Cited

U.S. PATENT DOCUMENTS

| | | | | |
|---|---|---|---|---|
| 4,621,749 A | | 11/1986 | Kanfer | 222/153 |
| 5,265,772 A | | 11/1993 | Bartasevich | 222/214 |
| 5,370,267 A | | 12/1994 | Schroeder | 222/1 |
| 5,443,236 A | | 8/1995 | Bell et al. | 248/311.3 |
| 5,464,125 A | * | 11/1995 | Daansen | 222/156 |
| 5,465,877 A | | 11/1995 | Bell et al. | 222/181.2 |
| 5,625,659 A | | 4/1997 | Sears | 377/21 |
| 5,944,227 A | | 8/1999 | Schroeder et al. | 222/144.5 |
| 6,216,916 B1 | | 4/2001 | Maddox et al. | 222/105 |
| 6,390,329 B1 | | 5/2002 | Maddox | 222/25 |

* cited by examiner

*Primary Examiner*—Kevin Shaver
*Assistant Examiner*—Stephanie Willatt
(74) *Attorney, Agent, or Firm*—Reese Taylor

(57) ABSTRACT

A lock-out mechanism for use with a dispenser having a back plate and a cover hingedly attached thereto for receipt of a refill container with an attached pump. The cover carries a pressure member in the form of a push bar having a pump activating projection which normally activates the pump by engaging a collapsible portion thereof when the push bar is activated and the refill cartridge and pump are properly seated within the dispenser. The push bar also carries an interference rib on the push bar which projects therefrom and engages a non collapsible portion of the pump and prevents the pump activating projection from engaging the collapsible portion of the pump when the pump is misseated in the dispenser.

3 Claims, 6 Drawing Sheets

LOCK-OUT MECHANISM FOR DISPENSER

RELATED PATENT APPLICATIONS

None.

FIELD OF THE INVENTION

This invention relates in general to wall-mounted dispensers for dispensing fluid material from refill containers received within the dispenser and carrying a dispensing pump activated through the cover to dispense material and relates in particular to a means for disabling the pump activating means to prevent activation of the pump in the event the refill container and pump are mislocated within the dispenser.

BACKGROUND OF THE INVENTION

Dispensing systems of the type involved in the present invention are well known in the prior art as can be seen from any number of prior art patents, such as, Kanfer U.S. Pat. No. 4,621,749; Bartasevich U.S. Pat. No. 5,265,772; Schroeder U.S. Pat. No. 5,370,267; Bell U.S. Pat. No. 5,443,236; Bell U.S. Pat. No. 5,465,877; Sears U.S. Pat. No. 5,625,659; Schroeder U.S. Pat. No. 5,944,227; Maddox U.S. Pat. No. 6,216,916; Maddox U.S. Pat. No. 6,390,329 and others. These pumps are generally utilized to dispense various fluids such as soaps, lotions and other skin care products. The dispensers are often employed also to dispense more than one product depending upon the nature of the cartridge or refill element inserted into the dispenser.

The dispensers generally include a backplate which can be mounted on a wall or other vertical surface and a cover hinged to the back plate. The cover is movable between open and closed positions with regard to the back plate and a replacement or refill cartridge or other source of the fluid material is received on the back plate and held in place by the cover when closed.

These refill cartridges or other containers also carry with them pumps of various designs and the cover has a pressure member which, when activated, engages the pump to draw material from the container and pass it out to the hand of the user.

Inasmuch as the dispensers are often used for dispensing more than one type of product, it becomes important that they are only refilled with that type of product inasmuch as there are commonly labels on the exterior of the cover describing the nature of the contents. It is often difficult to ensure that only the proper product will be placed in the dispenser in conformity with the information on the outside of the dispenser.

In the past, various methods have been utilized to prevent either inadvertent or intentional dispenser refilling with the wrong product. One method of doing so has been to provide a locating member on the back plate and a spout key on the exit nozzle of the pump. The exit nozzle is configured or keyed in such a way that it presumably will only mate with the configuration of the receptacle in the dispenser in order to ensure that only the proper refill for a given dispenser is utilized.

Problems do arise, however, with these solutions to the problem due to the fact that, in view of the nature of the material from which the nozzles and the fitment members which receive the nozzles in the dispenser are fabricated, it is possible to force fit the wrong nozzle into the wrong dispenser fitment and, thus, into the wrong dispenser so that the user does not receive the intended material when the pump is activated.

It is accordingly believed desirable to provide a means for ensuring that the pump will not operate properly unless the proper insert or replacement cartridge or container is utilized even in the event of a force fit between the nozzle and the fitment which, in most events, will not provide full seating of the nozzle.

SUMMARY OF THE INVENTION

It accordingly becomes the principal object of this invention to provide a lock-out or interference means which will prevent activation of the pump of a dispenser of this nature unless the proper refill cartridge is utilized and properly seated in the fitment member.

In furtherance of that object, it has been found that the pressure bar or other activating member of the cover can be provided with a transverse rib on its interior surface so that when the activating member or push bar is pushed inward, to presumably depress the pump and activate it to eject material to the hand of the user, the rib will contact the rigid portion of the pump and prevent the push bar from engaging the depressible member and, therefore, to prevent it from activating the pump.

Accordingly, it becomes the principal object of this invention to provide an improved lock-out mechanism for a dispenser having the above-identified characteristics with further objects of the invention becoming more apparent upon a reading of the following brief specification considered and interpreted in view of the accompanying drawings.

BRIEF DESCRIPTION OF THE PREFERRED EMBODIMENTS

Figure 1:
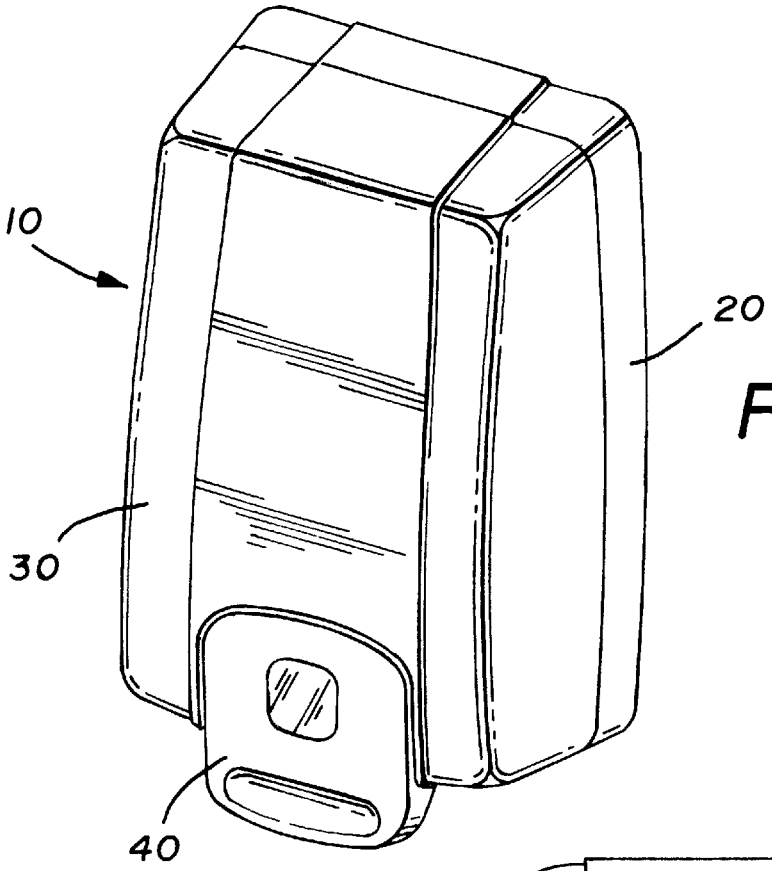
FIG. 1 is a perspective view of the dispenser in the closed position.
Figure 2:
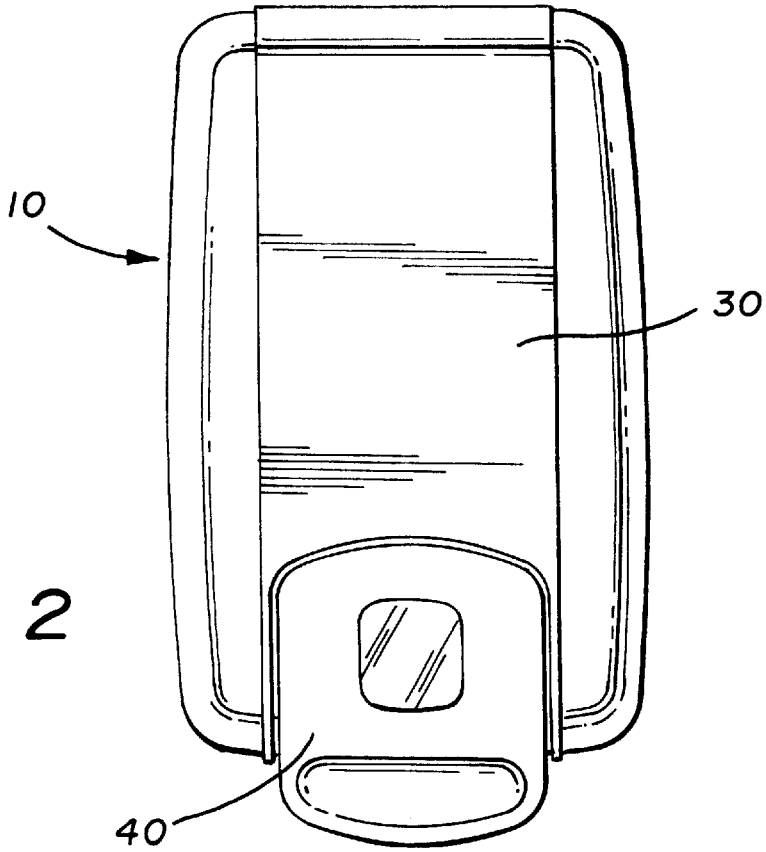
FIG. 2 is a front elevational view thereof.
Figure 3:
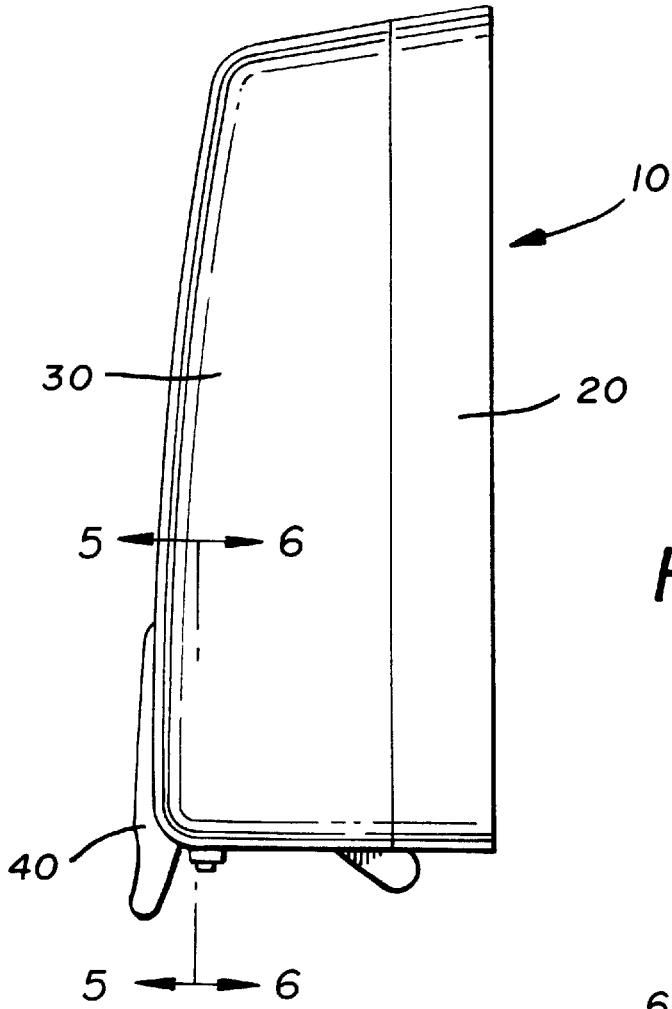
FIG. 3 is a side elevational view thereof.

Turning first to FIGS. 1, 2 and 3 of the drawings, it will be noted that the dispenser, generally indicated by the numeral 10, includes a back plate 20 and a cover 30. The cover 30 carries a pressure member or activating member 40. It will be understood that the particular configuration and design of the dispenser per se is being illustrated for illustrative purposes only and that the invention may well have equal utility with other forms of dispensers and pumps.

Continuing the description of the structure with particular reference to FIGS. 1, 2, 3 and 4 of the drawings, it will be seen that the cover 30 carries a push bar or activating member 40. That member carries an inwardly extending pump engagement member 41 which is intended to engage the depressible member 62 of the pump 60 when the cover 30 is closed and the push bar or activating member 40 is moved inwardly as will be described below.

Also carried on the interior surface of the push bar or activating member 40 is a transverse rib 41 which accomplishes the lock-out function as will be described.

Figure 7:
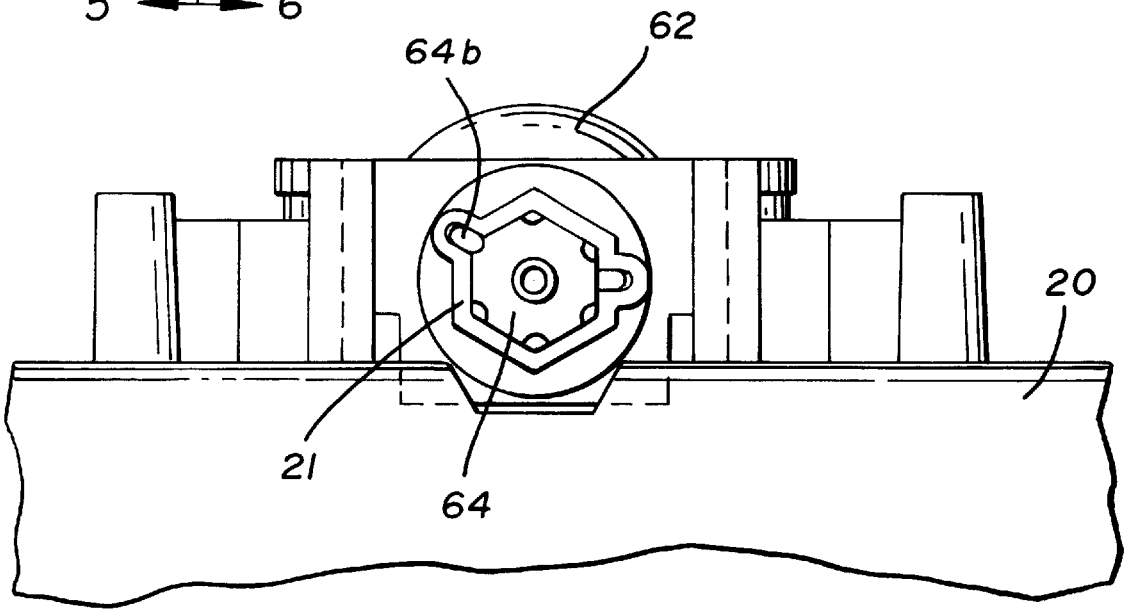
FIG. 7 is a partial bottom view of the dispenser taken along the line 7—7 of FIG. 6.
Figure 4:
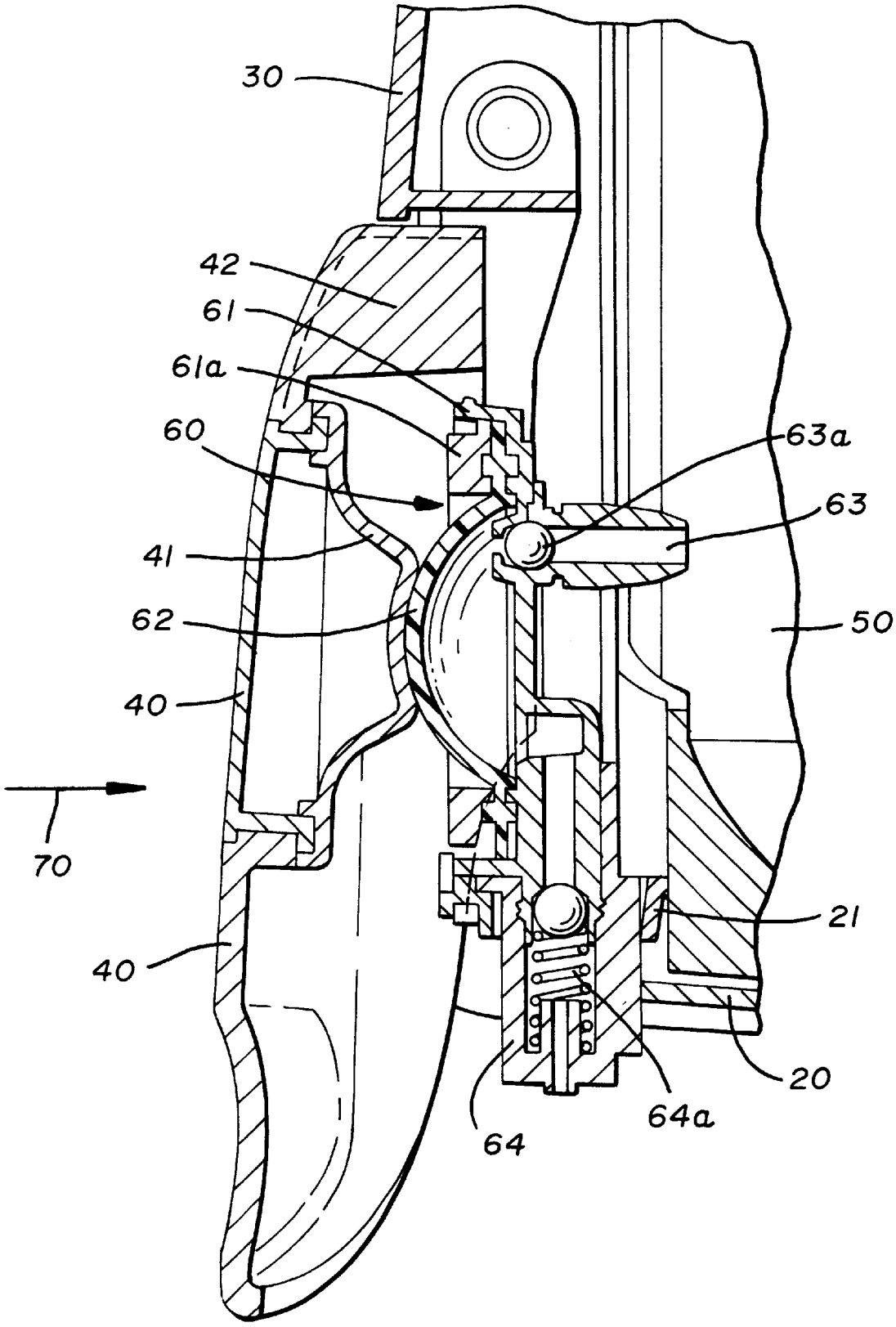
FIG. 4 is a partial side elevational view thereof partially in section showing a properly seated replacement cartridge and pump nozzle and showing the cover in the closed position with the pressure bar or activating member engaging the depressible portion of the pump.

Still referring to FIG. 4 of the drawings, it will be seen that the back plate 20 carries a fitment member, which can be seen in FIG. 7 of the drawings, and the pump nozzle 64 has projections or other configurations on its external surface intended to mate with the interior configuration of the fitment member 21 so as to ensure that only the proper nozzle is utilized or will fit. It should be noted here, however, that, as previously noted, due to the nature materials, which are generally relatively soft plastic, used for the nozzle and the fitment member 21, that it is possible to force the wrong nozzle at least part of the way into the fitment member 21.

Still referring to FIG. 4 for a more detailed examination of the pump 60, it will be seen that this pump includes a body portion made of relatively rigid material, a collapsible or depressible dome member 62 and a closure ring 61*a* which holds the depressible member 62 in the main body 61. Suitable inlet and outlet projections 63 and 64 are provided and they are provided with suitable valving 63*a* and 64*a* with the operation of the pump being fairly conventional such as shown and described in Maddox U.S. Pat. No. 6,216,916, for example. Generally the nozzle 64 and the fitment are "keyed" or configures according to the material intended to be dispensed from a given container.

Suffice it to say that depression of the collapsible member 62 will force material trapped in the dome or aperture between the members 62 and the main body 61 to unseat the valve 64*a* to permit that material to be expelled through the nozzle onto the hand of the user. Subsequently, as the pressure bar or activating member 40 is released, the pump, being resilient, will tend to return to the FIG. 4 position drawing another charge of material into the pump from the container or reservoir 50 through inlet 63.

Figure 4A:
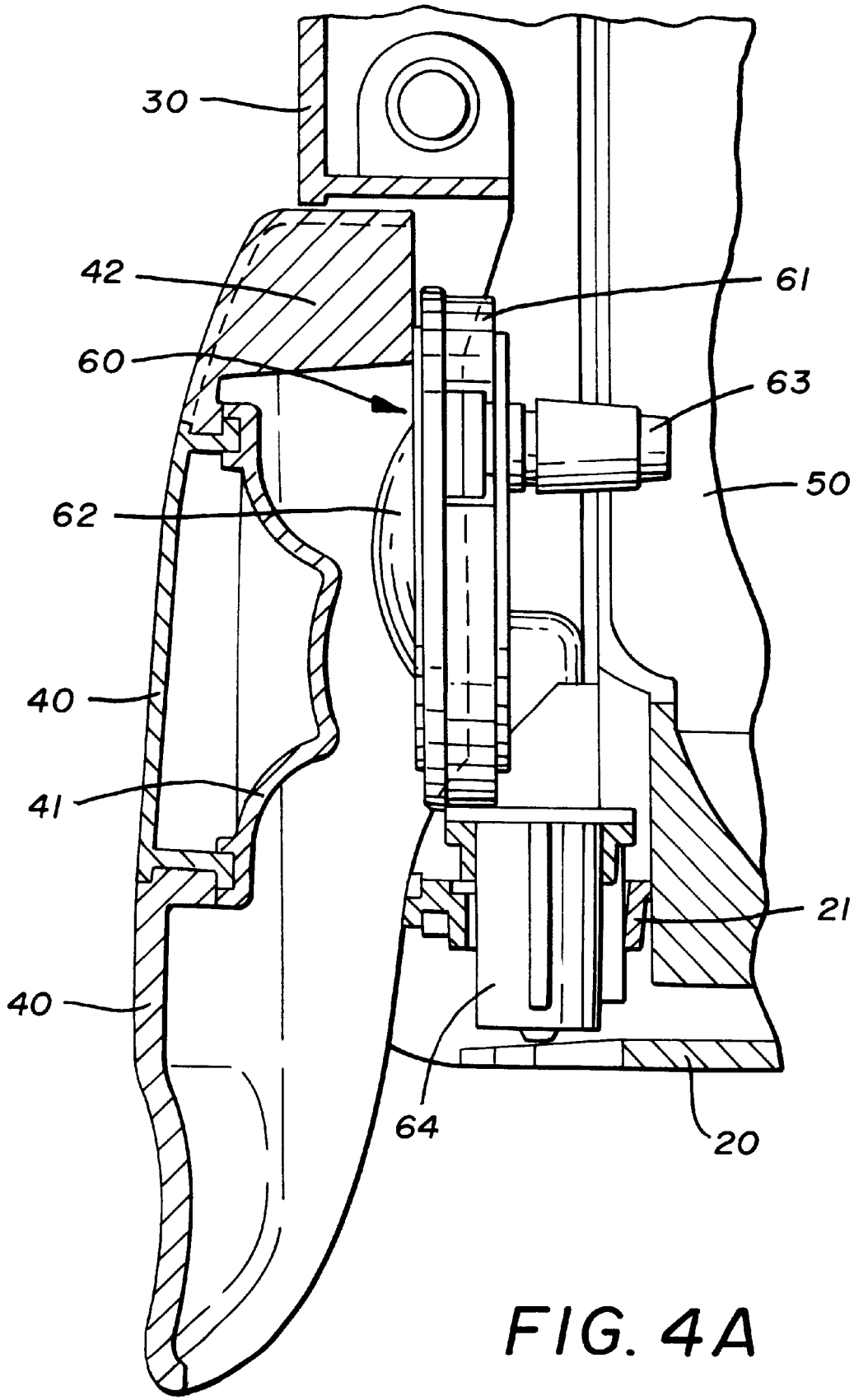
FIG. 4A is a similar view to FIG. 4 showing the engagement of the interference member or rib and an improperly engaged nozzle and pump showing the "lock-out" feature of the invention.
Figure 5:
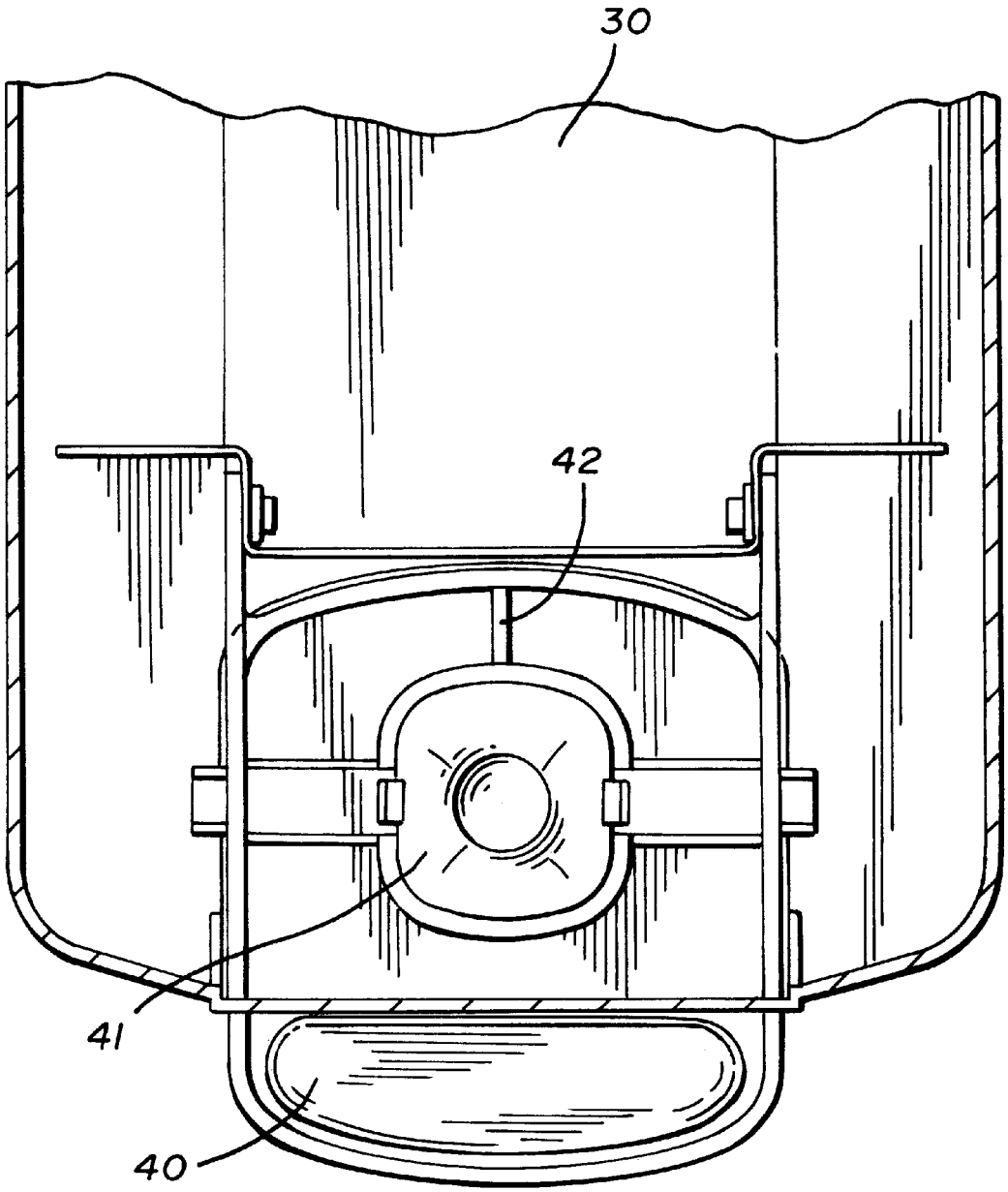
FIG. 5 is a partial sectional elevational view taken along the line 5—5 of FIG. 3.
Figure 6:
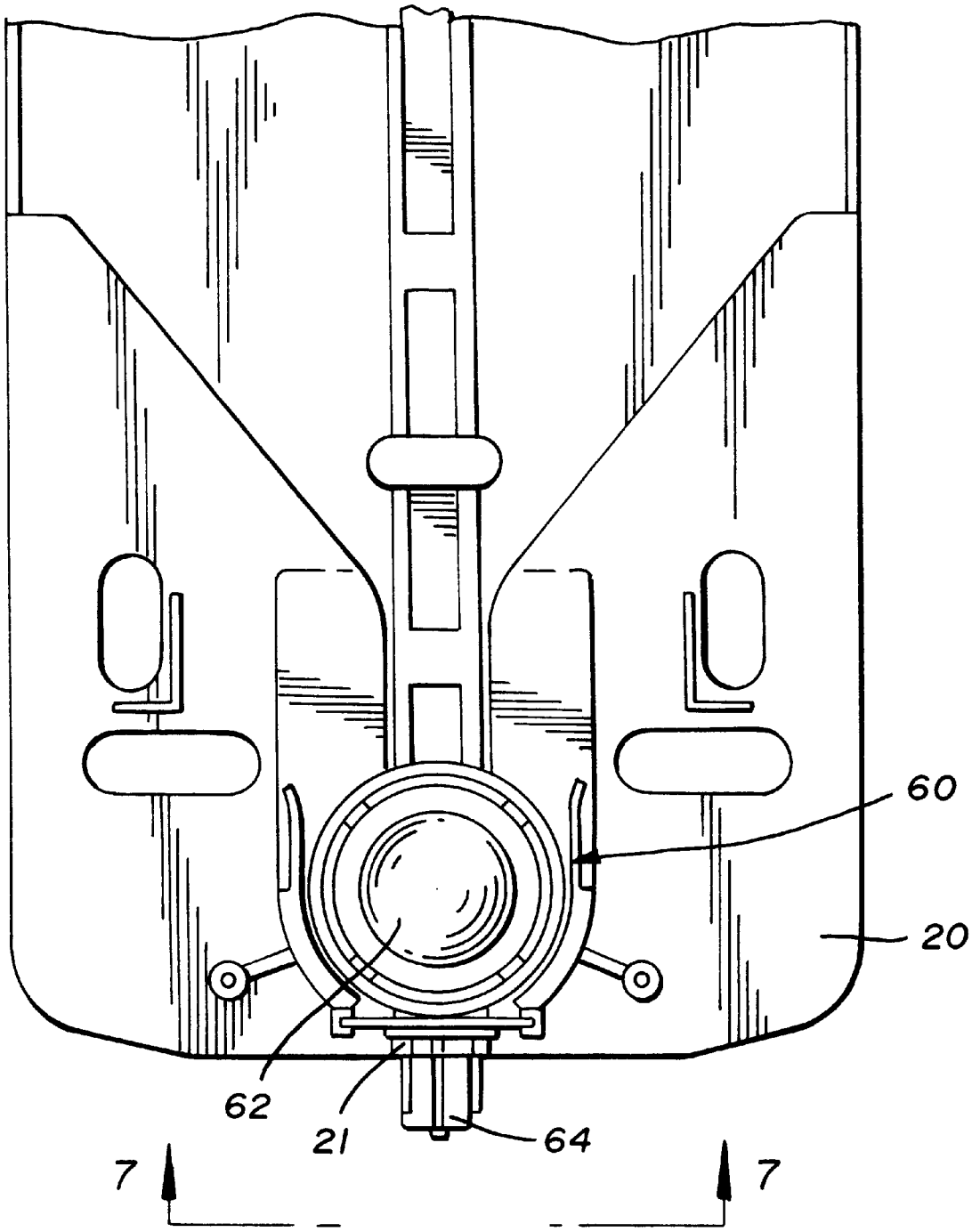
FIG. 6 is a partial sectional view taken along the line 6—6 of FIG. 3.

Turning next then to FIGS. 4 and 4*a*, it will be noted that if the nozzle 64 is the proper nozzle and is fully seated in the fitment 21, further movement of the pressure bar or activating member 40 in the direction of the arrow 70 will cause the dome to collapse and activate the pump, thereby releasing a charge of material to the user. Release of the pressure bar or activating member 40 permits the collapsible resilient member 62 to return to the configuration shown in FIG. 4 simultaneously refiling the pump chamber.

If, however, the nozzle 64 is not properly seated in the fitment 21, depression of the push bar or activating member 40 will cause the rib 42 to engage the plastic or fairly rigid body 61 of the pump and prevent further depression of the push bar or activating member 40 thereby preventing the extension 41 of the push bar from engaging the depressible member or dome 62. This will alert the person doing the refilling that, in fact, either the wrong material or replacement container has been utilized or that the nozzle is not properly located. In turn, this would prevent the dispensing of the wrong material from the wrong dispenser either inadvertently or intentionally.

While a full and complete description of the invention has been set forth in accordance with the dictates of the Patent Statutes, it should be understood that modifications can be resorted to without departing from the spirit hereof or the scope of the appended claims.

What is claimed is:

1. A dispenser for dispensing fluids from a refill container through a pump carried by the refill container comprising:

a) an elongate back plate;

b) an elongate cover hingedly connected at one end to one end of said back plate and movable between covering the uncovering relationship with said back plate;

c) locating means carried by said back plate for locating the pump of the refill container on said back plate;

d) an activating member carried by said cover and movable into and out of activating contact with the pump when said cover is in covering relationship with said back plate; and e) interference means carried by said cover and preventing movement of said activating member into activating contact with the pump when the pump is not properly located in said locating means.

2. The dispenser of claim 1 wherein the pump includes a substantially rigid body and a depressible member carried by said body and engagable with said activating member when said pump is properly located in said locating means.

3. The dispenser of claim 2 wherein said interference means include at least one rib projecting from said cover toward said back plate and movable into engagement with said rigid body when said pump is not properly located in said locating means to prevent contact of said activating means with said depressible member.

* * * * *